US008374376B2

(12) United States Patent
Kurbis et al.

(10) Patent No.: US 8,374,376 B2
(45) Date of Patent: Feb. 12, 2013

(54) MICROPHONE UNIT

(75) Inventors: Manfred Kurbis, Wedemark/Reese (DE); Dela Bahlke, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 325 days.

(21) Appl. No.: 12/685,366

(22) Filed: Jan. 11, 2010

(65) Prior Publication Data

US 2010/0177923 A1 Jul. 15, 2010

(30) Foreign Application Priority Data

Jan. 12, 2009 (DE) ..... 10 2009 004 662

(51) Int. Cl.
*H04R 25/00* (2006.01)

(52) U.S. Cl. ..... 381/381; 381/370; 381/375

(58) Field of Classification Search ..... 381/309, 381/330, 370–375, 379, 381
See application file for complete search history.

(56) References Cited

U.S. PATENT DOCUMENTS

| | | | | |
|---|---|---|---|---|
| 2,506,490 | A * | 5/1950 | Coley | 381/380 |
| 4,289,938 | A * | 9/1981 | Zichy | 381/381 |
| 6,396,935 | B1 | 5/2002 | Makkonen | |
| 8,073,180 | B2 * | 12/2011 | Bruckhoff | 381/381 |

* cited by examiner

*Primary Examiner* — Suhan Ni
(74) *Attorney, Agent, or Firm* — Kilpatrick Townsend & Stockton LLP

(57) ABSTRACT

There is provided a microphone unit comprising a hoop (10) with a first and second end (11, 12), a microphone capsule (20) at the first end (11) and a connection plug (30) at the second end (12) of the hoop (10). The hoop (10) has a flexible or bendable tubular hoop and is bent or is bendable to form a loop.

3 Claims, 1 Drawing Sheet

MICROPHONE UNIT

CROSS-REFERENCE TO RELATED APPLICATIONS

This application claims priority to German Patent Application No. 102009004662.3, filed Jan. 12, 2009, the disclosure of which is hereby incorporated by reference in its entirety for all purposes.

BACKGROUND

The present invention concerns a microphone unit.

Microphone units such as for example ear hook units are used in many fields such as for example in call centers or also in connection with events or concerts. In that case the microphones can be for example in the form of boom microphones and can be fixed to a band which is in the form of a behind-the-neck band.

Known ear hook microphones however are poorly held in place, they do not offer a secure fit and they do not provide for lasting positioning of the microphone.

U.S. Pat No. 6,396,935 discloses a headset having a boom arm which is designed to be adjustable or deformable. The boom arm can have an arm. The arm can also be in the form of a metal or plastic wire which is wound in a spiral configuration.

Thus an object of the present invention is to provide a microphone unit which can be worn by a wearer on the head and which has improved wearing comfort.

SUMMARY

That object is attained by a microphone unit as set forth in claim 1.

Thus there is provided a microphone unit having a hoop band with a first and a second end, a microphone capsule at the first end and a connection plug at the second end of the hoop. The hoop has a flexible tubular hoop and is bent or is bendable to form a loop.

In accordance with an aspect of the present invention the tubular hoop has a modulus of elasticity of between 100 and 300 kN/mm$^2$ and in particular 200 kN/mm$^2$.

In accordance with a further aspect of the present invention there is provided a boom microphone having a band hoop with a first end and a second end. The hoop has a flexible tubular hoop which is bendable to form a loop.

The present invention concerns the concept of providing a curved tubular hoop on the basis of the principle of a spring turn. In that case the tubular hoop can be for example of a D-shape. The bent tubular hoop means that it is possible to provide a loop in the hoop, which can be fitted over the ear of a user in order thus to be able to provide a firm comfortable fit. The spring action of the wire or the tubular hoop means that the ear hook is held securely to an ear of a user and is scarcely visible and can hardly be felt. In addition rapid fitting and removal is possible.

Further configurations of the invention are subject-matter of the appendant claims.

BRIEF DESCRIPTION OF THE DRAWINGS

Advantages and embodiments by way of example of the invention are described in greater detail hereinafter with reference to the drawings.

DETAILED DESCRIPTION

Figure 1:
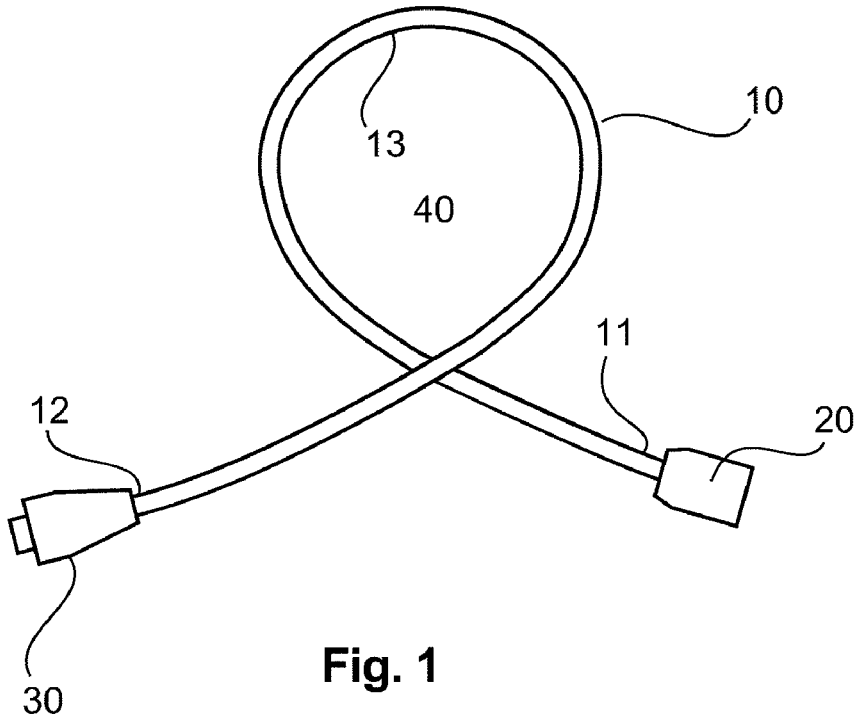
FIG. 1 shows a diagrammatic view of a microphone unit according to a first embodiment.
Figure 2:
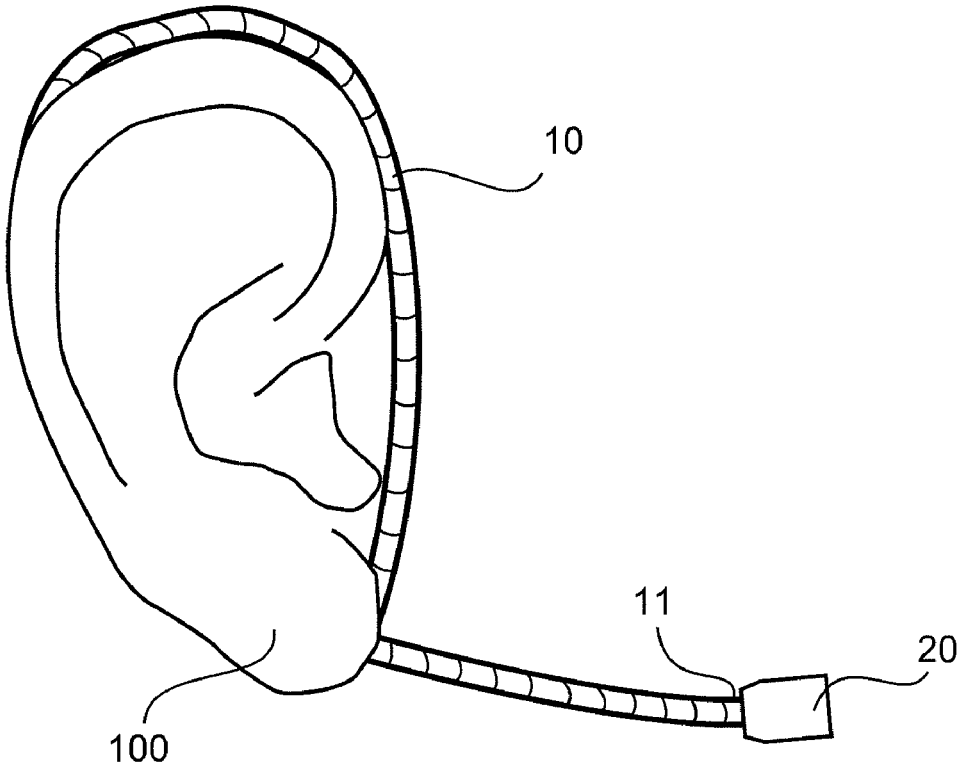
FIG. 2 shows a further diagrammatic view of a microphone unit according to the first embodiment.
Figure 1:
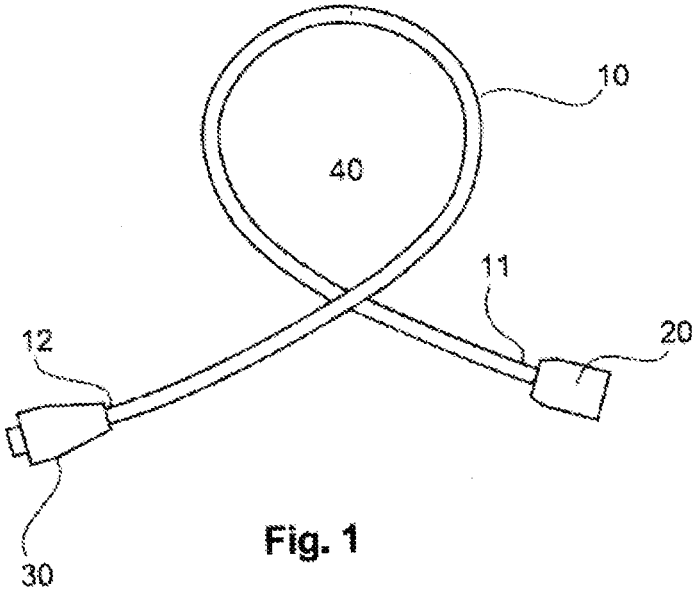
Figure 2:
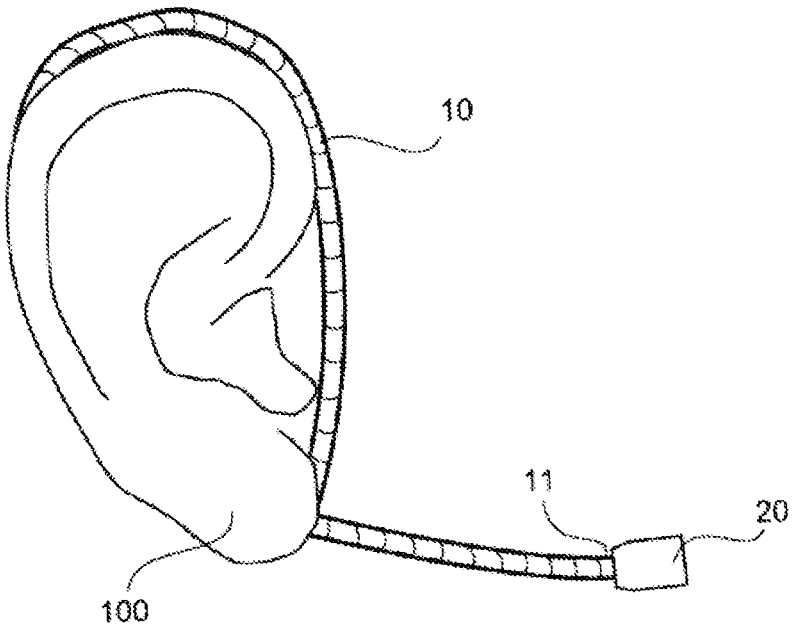

FIG. 1 shows a diagrammatic view of a microphone unit according to a first embodiment. The microphone unit has a first end 11 with a microphone capsule 20 and a second end 12 with a connection plug 30. The microphone capsule 20 and the plug 30 are electrically coupled. The microphone unit further has a band or hoop 10 which can be in the form of a tubular hoop. The hoop 10 can in that case be bent in such a way that a loop 40 can be made possible. The loop 40 can be fitted for example over an ear of a user so that the microphone unit can fit securely to an ear of a user, as shown in FIG. 2.

The bendable tubular hoop can be in the form of or can be bendable as a spring turn, in particular in a D-shape or an O-shape.

The material of the tubular hoop can have for example a modulus of elasticity of between 100 and 300 kN/mm$^2$, in particular 200 kN/mm$^2$, (180 kN/mm$^2$ at 300° C.; 165 kN/mm$^2$ at 500° C.). The tube diameter is between 0.8 mm and 2 mm. The material thickness is between 0.1 mm and 0.2 mm.

The tubular hoop can comprise a material X5CrNi18-10 (Gritzbach GmbH, Friolzheim), of the following chemical composition (percent by weight):

Fe balance: C<0.07; Cr 17.0-19.5; Ni 8.0-10.5; Si<=1.0; Mn<=2.0; P<=0.045; S<=0.015; N<=0.110.

The material of the tubular hoop has a modulus of elasticity of 200 kN/mm$^2$. The Poisson constant is 0.3. Density is 7.9 kg/dm$^3$. The melting point or melting range is 1420-1470° C. The coefficient of thermal expansion between 200 and 300° C. is 0.00016. Thermal conductivity at 20° C. is 15 W/m ° K. The specific electrical resistance is 73 μΩm. Specific heat at 20° C. is 500 J/(kg K).

The invention claimed is:

1. A microphone unit comprising:

a hoop with a first end and a second end, a microphone capsule at the first end of the hoop, and a connection plug at the second end of the hoop, wherein the hoop comprises a flexible or bendable tubular hoop, wherein the hoop comprises a loose crossing in a region of the first end and the second end to form a closed adjustable loop that can be fitted over an ear of a user, and wherein the hoop comprises a spring action to hold the closed adjustable loop securely to the ear of the user.

2. A microphone unit as set forth in claim 1 wherein the tubular hoop has a modulus of elasticity of between 100 and 300 kN/mm$^2$.

3. A boom microphone comprising:

a hoop with a first end and a second end and a flexible tubular hoop, the hoop comprising a loose crossing in a region of the first end and the second end to form a closed adjustable loop that can be fitted over an ear of a user and comprising a spring action to hold the closed adjustable loop securely to the ear of the user.

* * * * *

UNITED STATES PATENT AND TRADEMARK OFFICE

CERTIFICATE OF CORRECTION

PATENT NO. : 8,374,376 B2
APPLICATION NO. : 12/685366
DATED : February 12, 2013
INVENTOR(S) : Kurbis et al.

It is certified that error appears in the above-identified patent and that said Letters Patent is hereby corrected as shown below:

The title page, showing an illustrative figure, should be deleted and substitute therefor the attached title page.

In the Figures:

In FIG. 1, identifier number "13" and the associated arrow should not be included in the Figure. A replacement sheet has been included that excludes said identifier. (see attached sheet)

In the Specification:

In column 1, line 27, please add a "," after "Thus."

In column 1, line 34, please add a "," after "Thus."

In column 1, line 48, please add a "," after "In that case."

In column 1, line 48, please add a "," before and after "for example."

In column 1, line 34, please add a "," after "In addition."

In column 1, line 55, please delete "is possible" and insert --are possible--.

In column 2, line 17, please add "100" after "ear."

In the Claims:

In claim 1, line 2, please delete the "," after "second end" and replace it with a ";".

In claim 1, line 3, please delete the "," after "of the hoop" and before "and" and replace it with a ";".

In claim 3, line 2, please place a ";" after "a second end."

Signed and Sealed this
Twenty-third Day of July, 2013

Teresa Stanek Rea
*Acting Director of the United States Patent and Trademark Office*

(12) United States Patent
Kurbis et al.

(10) Patent No.: US 8,374,376 B2
(45) Date of Patent: Feb. 12, 2013

(54) MICROPHONE UNIT

(75) Inventors: Manfred Kurbis, Wedemark/Reese (DE); Dela Bahlke, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 325 days.

(21) Appl. No.: 12/685,366

(22) Filed: Jan. 11, 2010

(65) Prior Publication Data

US 2010/0177923 A1 Jul. 15, 2010

(30) Foreign Application Priority Data

Jan. 12, 2009 (DE) ..... 10 2009 004 662

(51) Int. Cl.
*H04R 25/00* (2006.01)

(52) U.S. Cl. ..... 381/381; 381/370; 381/375

(58) Field of Classification Search ..... 381/309, 381/330, 370–375, 379, 381
See application file for complete search history.

(56) References Cited

U.S. PATENT DOCUMENTS

| | | | | |
|---|---|---|---|---|
| 2,506,490 | A * | 5/1950 | Coley | 381/380 |
| 4,289,938 | A * | 9/1981 | Zichy | 381/381 |
| 6,396,935 | B1 | 5/2002 | Makkonen | |
| 8,073,180 | B2 * | 12/2011 | Bruckhoff | 381/381 |

* cited by examiner

*Primary Examiner* — Suhan Ni
(74) *Attorney, Agent, or Firm* — Kilpatrick Townsend & Stockton LLP

(57) ABSTRACT

There is provided a microphone unit comprising a hoop (10) with a first and second end (11, 12), a microphone capsule (20) at the first end (11) and a connection plug (30) at the second end (12) of the hoop (10). The hoop (10) has a flexible or bendable tubular hoop and is bent or is bendable to form a loop.

3 Claims, 1 Drawing Sheet

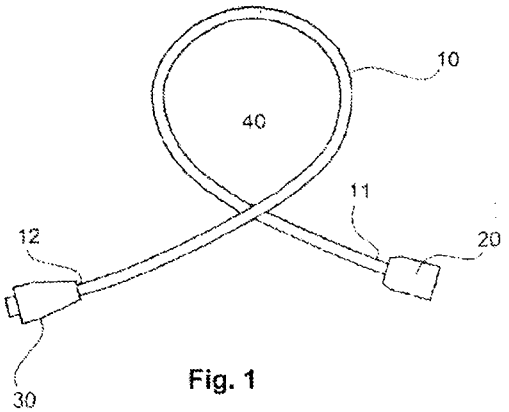

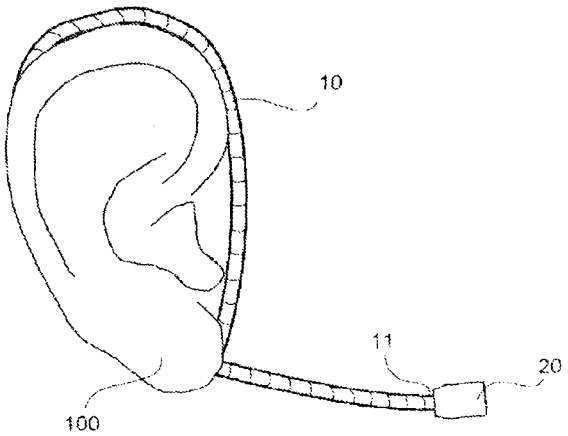

Fig. 1